United States Patent [19]

Eichler

[11] 4,046,295

[45] Sept. 6, 1977

[54] CARRYING DEVICE FOR PORTABLE ARTICLE

[75] Inventor: Jay H. Eichler, Boca Raton, Fla.

[73] Assignee: Motorola, Inc., Schaumburg, Ill.

[21] Appl. No.: 563,946

[22] Filed: Mar. 31, 1975

[51] Int. Cl.[2] ..... A45C 11/24

[52] U.S. Cl. ..... 224/5 H; 224/26 R

[58] Field of Search ..... 224/5 R, 5 A, 5 H, 26 R, 224/26 B, 26 K, 27, 5 E, 2 B, 2 C, 2 D

[56] References Cited

U.S. PATENT DOCUMENTS

| | | | |
|---|---|---|---|
| 1,321,960 | 11/1919 | Wheat | 224/5 H |
| 1,422,610 | 7/1922 | O'Brien | 224/26 K |
| 2,304,367 | 12/1942 | Meyer et al. | 224/5 A |
| 2,500,257 | 3/1950 | Mahan | 224/5 H |
| 2,592,209 | 4/1952 | Stamper | 224/5 H |
| 2,687,833 | 8/1954 | Sutton | 224/2 |
| 2,753,094 | 7/1956 | Haney, Jr. | 224/5 A |
| 2,781,958 | 2/1957 | Lewandowski | 224/5 E |
| 3,215,322 | 11/1965 | Boyer et al. | 224/26 R |
| 3,307,756 | 3/1967 | Brunosson | 224/2 |
| 3,482,748 | 12/1969 | Roberts, Jr. | 224/26 R |
| 3,631,994 | 1/1972 | Mackzum, Jr. | 224/26 R |

FOREIGN PATENT DOCUMENTS

| | | | |
|---|---|---|---|
| 111,022 | 6/1944 | Sweden | 224/2 D |
| 225,019 | 11/1924 | United Kingdom | 224/5 H |

*Primary Examiner*—L. J. Paperner
*Assistant Examiner*—Donald W. Underwood
*Attorney, Agent, or Firm*—Donald B. Southard; James W. Gillman

[57] ABSTRACT

A carrying device for an elongated portable article has a back plate with an integral portion forming a loop for receiving the article, with a stop surface adapted to be engaged by a ledge on the article. The device includes a latch secured to the back plate having a projection cooperating with a part of the article to hold the article in the device. The device can be adapted to carry a portable radio having controls on the top and side and a grille at the front, with the ledge being below the side control. The controls and the speaker grille are not obstructed when the radio is being carried. The device can be used to carry radios which vary in length and in other respects, which are of a size to be positioned within the loop and which have a ledge and a part at a fixed position with respect to the ledge to cooperate with the latch. A belt loop or other mounting element can be attached to the device for supporting the same.

8 Claims, 7 Drawing Figures

CARRYING DEVICE FOR PORTABLE ARTICLE

BACKGROUND OF THE INVENTION

Small portable articles, such as radio transmitter and receiver units, have been provided which can be held in one hand while being used. However, it is desired to provide a case or holder for carrying the article when it is not being used. Such cases have been provided with a belt loop or clip, or other mounting for carrying on a person. Cases which have been used are objectionable in that the radio cannot be used in the carrying case, and to remove the radio takes some time and usually requires the use of both hands. Such cases have a flap which must be opened and then the radio must be removed from the case, and similar operations are involved to place the radio in the case.

Another problem has been that a different case has been required for each device and for each model of the device. For example, radio devices of the same general type can have models of different sizes, as required when different features are included and to provide batteries of different sizes. This requires having a large number of different cases available, and as the cases have been relatively expensive, the cost of providing the various different cases is objectionable.

SUMMARY OF THE INVENTION

An object of this invention is to provide a simply carrying device for a portable article.

Another object of the invention is to provide an improved carry holder for a portable radio which can be used with radios of different sizes.

A further object of the invention is to provide a carry holder for a portable article which is molded of plastic material and which has a latch for securing the article in the holder.

A still further object is to provide a carrying device for a portable radio which is of inexpensive construction, which holds the radio with the controls thereof accessible for use, and which permits easy insertion and removal of the radio.

In practicing the invention there is provided a carrying holder for a portable article, such as a hand held radio transmitter and receiver, which includes a back plate formed with an integral loop for receiving the article. The article includes a projection or ledge and the holder includes a stop surface on which the ledge rests when the article is inserted in the loop. A latch is secured to the back plate which has a projection which extends over a part of the article when the article is in the holder, with the ledge engaging the stop surface. This holds the article in the holder, and the latch can flex to allow the projection to be moved clear of the article so that it can be withdrawn from the holder. The holder has no bottom wall so that it can be used with articles of different lengths. The holder can be used with any article which fits within the loop, which has a ledge which will rest on the stop surface and a part at a fixed position with respect to the ledge to cooperate with the latch. When used to carry a portable radio the controls of the radio are accessible, and the radio can be removed from the holder, or replaced therein, by use of one hand. A belt flap or clip, or any other mounting, such as a swivel mounting, can be used to support the holder on a person.

DETAILED DESCRIPTION OF THE DRAWINGS

Figure 1:
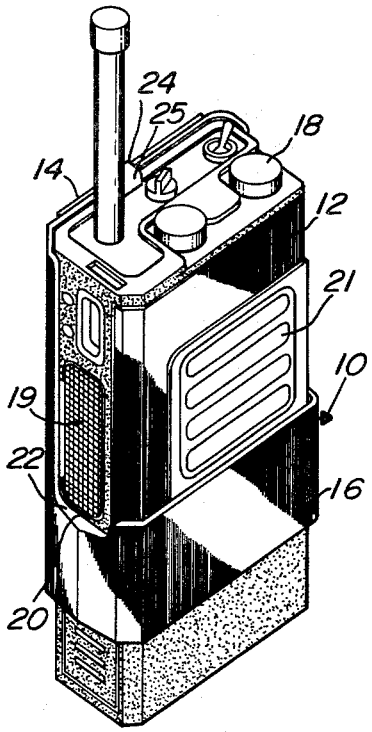
FIG. 1 is a perspective view of the carry holder of the invention with a portable radio therein.
Figure 2:
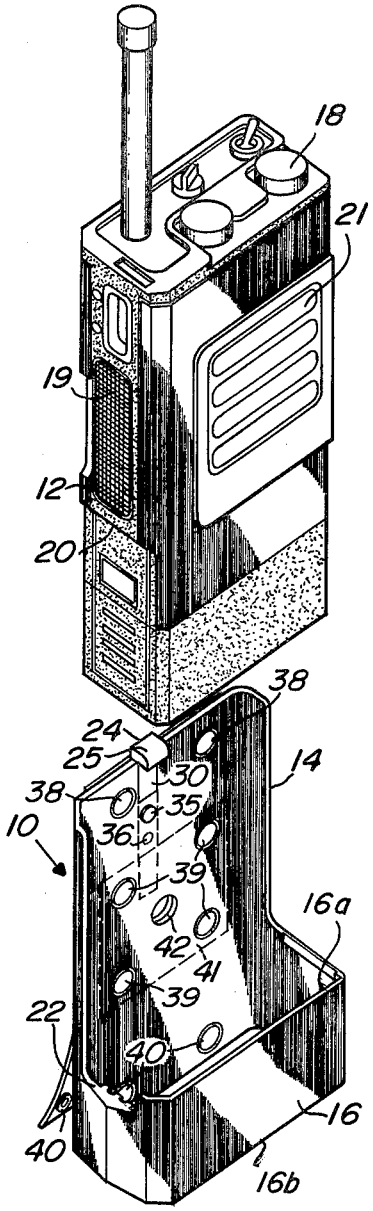
FIG. 2 shows the radio out of the holder.

FIG. 1 shows the carry holder 10 of the invention with a small radio transmitter and receiver 12 therein. FIG. 2 shows the same structure with the radio above the holder. The holder includes a back plate 14 against which the back of the radio 12 rests, and a loop 16 which surrounds the radio having top and bottom surfaces or edges 16*a* and 16*b*, respectively. The radio 12 has controls 18 on the top thereof and a push-to-talk switch 19 on one side. The housing of the radio 12 is recessed below the switch 19 forming a ledge 20, and the loop 16 has a stop surface 22 on which the ledge 20 rests. Secured to the back 14 of the holder 10 is a latch 24 which has a projection 25 which extends across a part of the top of the radio 12, when it is in position in the holder. A belt flap 26 may also be secured to the back 14.

Figure 3:
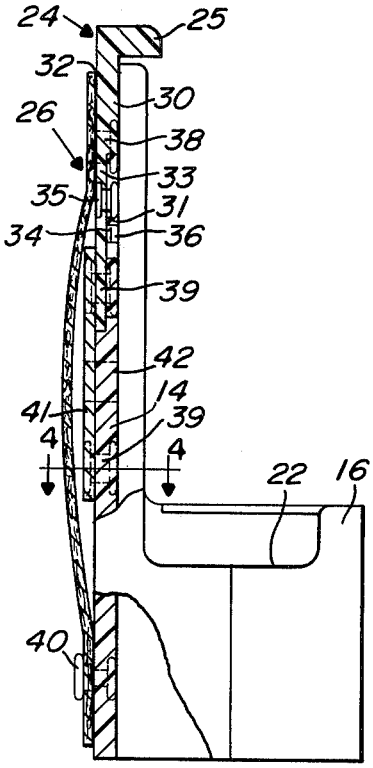
FIG. 3 shows the latch and belt flap of the holder.
Figure 4:
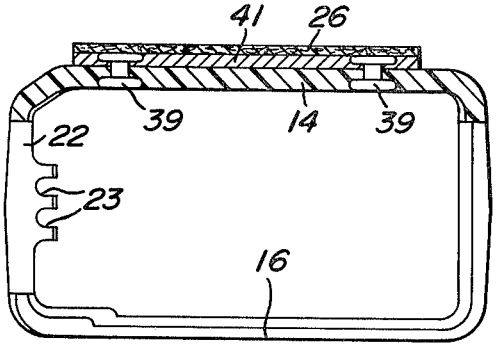
FIG. 4 is a top view of the loop of the holder along the lines 4—4 of FIG. 3.

FIGS. 3 and 4 show more in detail the construction of the holder 10. The back 14 and the loop 16 can be integrally molded as a single piece from a relatively rigid plastic material. The stop surface 22 can be below the top surface 16*a* of the loop to form a pocket for receiving the ledge 20 on the radio. As shown by FIG. 4, ribs 23 are provided in the loop at the stop surface 22 to provide a larger surface on which the ledge 20 on the article can rest.

FIG. 3 shows a part of the back 14 in cross section to better show the construction of the latch 24 and of the belt flap 26. A slot 30 is provided in the back plate 14 into which the arm 32 of the latch 24 is positioned. The arm 32 has a portion 33 of reduced thickness which is positioned in a recess 31 in the back plate 14 below the slot 30. A rivet 35 fastens the recessed portion 31 of the back to the arm portion 33 of the latch. The latch arm 32 also has a projection 34 thereon which fits into an opening 36 (best seen in FIG. 2) in the recessed portion 31 of the back plate 14. Projection 34 fitting into opening 36 as well as the portion of arm 32 fitting within slit 30 serves to align the overall latch mechanism 24 properly so that rivet 35 may be utilized to conveniently assemble the arm 32 to the back plate 14, substantially as shown in FIGS. 2 and 3. Further, the portion of arm 32 fitting within slot 30 also serves to fix latch mechanism 24 in a relatively fixed position and guard against any undesirable rotation of the arm 32 about its longitudinal axis. The material from which the back plate 14 and the latch 24 are formed, and the connection therebetween permits the latch 24 to flex so that the projection 25 thereon can move back to permit insertion of the radio into the holder and removal thereof. When the radio is being carried in the holder, the projection 25 extends across a part of the radio to hold the same therein, as shown by FIG. 1.

FIG. 3 also shows the belt flap 26 which can be used to mount the holder 10 on the belt of a person who is using the radio. The flap 26 can be riveted to the back 14 of the holder by rivets shown at 38. The latch 24 can be positioned between the edges of the back 14, either substantially at the center thereof, or off center as shown by FIGS. 1 and 2. The rivets 38 can be positioned on each side of the arm 32 of the latch 24 near the top of the back. Snaps 40 can be provided near the bottom of the flap 26 to hold the same to the bottom of the back 14. A pair of snaps can be provded spaced across the bottom of the back 14, which can be opened to allow the flap 26 to extend around a belt. The rivets 38 and snaps 40 provide a secure mounting of the flap 26 to the holder 10 so that the article carried by the holder is well supported other than the belt flap 26 may be provided for the carry holder 10. FIGS. 2, 3 and 4 show a mounting plate 41, which can be made of sheet metal, which is secured to the back of plate 14 of the holder 10 by any suitable means, such as by rivets 39 shown in FIGS. 2 and 3. The plate 41 has a center hole 42 aligned with a hole in the back plate 14 to which a mounting element can be readily and conveniently attached. For example, a swivel mounting element can be used, such as shown in in U.S. Pat. No. 3,743,147, issuing July 3, 1973 to Mieczyslaw Wilczynski, and assigned to the same assignee as the present invention. Accordingly, belt flap 26 in this instance may be retained or omitted, as desired by the user.

Figure 7:
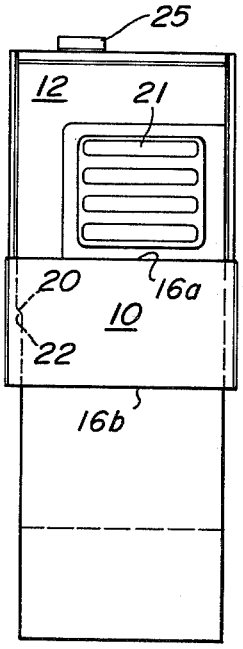
FIGS. 5, 6 and 7 show the holder with radios of different sizes.
Figure 6:
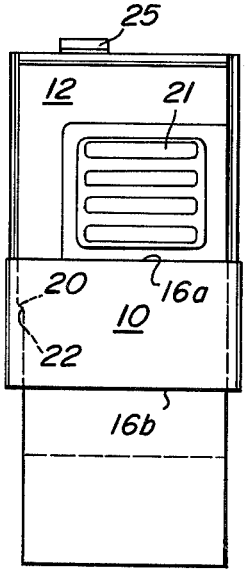
Figure 5:
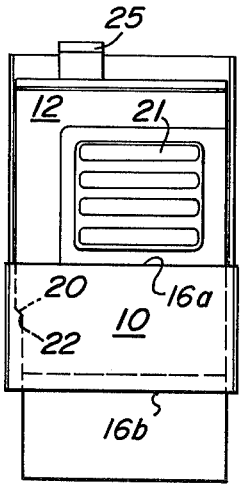

It will be apparent that the carry holder of the invention is an expensive structure which forms an effective holder for a portable article, such as a hand-held radio transmitter and receiver. The holder can be used for carrying articles which vary in length and other dimensions. FIGS. 5, 6 and 7 show the holder with radios of different lengths positioned therein. The radios illustrated have batteries at the bottom thereof, and the dotted line shows the length of the radio with a small battery attached and the solid line shows the length of the radio with a larger battery attached. It will be apparent that batteries of other lengths can also be used. The dimensions of the radio other than length can also vary and still allow use of the carrier. It is only necessary that the radio fit within the loop 14 and have a ledge or projection which will rest on the stop surface 22, and that there be a part at a fixed position with respect to the ledge over which the porjection 25 of the latch 24 will extend.

The carry holder of the invention permits insertion of a radio without obstruction of the controls 18, 19 thereof, or of a grille 21 on the front of the radio 12. It is very easy to insert a radio into the holder 10 and this can be done by the use of only one hand. Removal of the radio is also easy, and release of the latch 14 can be accomplished by springing or flexing the same by a finger of the hand which grasps the radio to remove the same.

As previously stated, the back 14 and loop 16 of the holder can be molded of plastic as a single piece. The latch 24 can also be molded of the same material. These parts can be formed of a relatively rigid material to provide a rugged support and still allow flexing of the latch. The flap can also be formed of a plastic material. The riveting of the latch 24 to the back 14 csn be very easily accomplished to provide a very inexpensive structure. The provision of the belt flap 26 or of another mounting element does not substantially complicate the same or greatly increase the cost.

The carry holder of the invention has been tested and found to be highly satisfactory in use. Its suitability for use with various models of portable radios makes it possible to provide the holder in large quantities for substantial cost savings. Accordingly, the holder can be provided at a small fraction of the cost of leather carrying cases designed to fit a particular radio model, as previously used.

I claim:

1. A carrying device for an elongated portable article of a predetermined height which has a ledge thereon intermediate its ends and a surface at a fixed position with respect to the ledge, such carrying device including in combination:

a supporting plate having a surface adapted to be engaged by the article, said plate further having a slot therein and a recess adjacent said slot, means secured to said plate forming a loop having open-ended top and bottom and a lateral dimension less than the height of the article, said loop being adapted to receive the article therein whereby the article extends above and below the lateral dimension of the loop, said loop having a stop surface in the interior thereof intermediate the top and bottom to be engaged by the ledge on the article, latch means including an arm extending into said slot and recess of said plate and further including means fastening said latch arm to said plate at said recess, said latch means being secured to a top portion of said plate and having a portion operating to overlie the fixed position surface of the article when the article is received in said loop to hold the article in position with the ledge thereon against said stop surface, and means secured to said plate for supporting the carrying device and the article.

2. The carrying device of claim 1 wherein said supporting plate and said means forming a loop are integrally molded.

3. The carrying device of claim 1 wherein said means forming a loop has ribs extending inwardly from the inner surface thereof adjacent said stop surface to reinforce the same.

4. The carrying device of claim 1 wherein said means for supporting the carrying device is a belt flap secured to said plate.

5. A carry holder for a portable radio of a predetermined height having a top with controls extending therefrom, a side with a switch actuator and a ledge below the actuator which is at a given spacing from the top, and a front with a grille in the top portion thereof, said carry holder including in combination:

a back plate and means extending forwardly thereof to form a loop having open-ended top and bottom and a lateral dimension less than the height of the radio, said lateral dimension of the loop being adapted for receiving the portable radio, said loop further having a more narrow lateral measurement at at least one point, said top of said more narrow lateral dimension comprising a stop surface to be engaged by the ledge on the side of the radio to support said radio, with the radio extending above and below the lateral dimension of said loop, latch means secured to a top portion of said back plate and having a portion for extending over the top of a radio positioned in said loop, and means secured to said back plate for supporting the carry holder.

6. The carry holder of claim 5 wherein said back plate and said means extending forwardly are integrally molded of plastic material.

7. The carry holder of claim 5 wherein said loop is constructed to extend below the grille of a radio therein, whereby the controls and switch actuator of a radio in the holder are accessible and the speaker grille is unobstructed.

8. The carry holder of claim 5 wherein said latch has an arm connected to said back plate supporting said extending portion of said latch means, said arm being constructed to flex to permit movement of said portion for insertion of the radio in said loop, and removal thereof.

* * * * *